United States Patent [19]

Durando et al.

[11] Patent Number: 4,859,196

[45] Date of Patent: Aug. 22, 1989

[54] UNDERWATER ELECTRIC CONNECTOR

[75] Inventors: Pierre Durando, Paris; Alain LaFaille, Vaucresson, both of France

[73] Assignees: Total Compagnie Fracaise des Petroles, Paris; Institut Francais du Petrole, Rueil Malmaison, both of France

[21] Appl. No.: 223,046

[22] Filed: Jul. 22, 1988

[30] Foreign Application Priority Data

Jul. 23, 1987 [FR] France ..... 87 10452

[51] Int. Cl.[4] ..... H01R 13/523

[52] U.S. Cl. ..... 439/197; 439/519

[58] Field of Search ..... 439/131, 132, 140, 141, 439/190, 197, 199, 201, 205, 519, 521

[56] References Cited

U.S. PATENT DOCUMENTS

| | | | |
|---|---|---|---|
| 3,641,479 | 2/1972 | O'Brien et al. | 439/277 |
| 3,729,699 | 4/1973 | Briggs et al. | 439/140 |
| 3,845,450 | 10/1974 | Cole et al. | 439/141 |
| 4,188,084 | 2/1980 | Buresi et al. | 439/201 |
| 4,589,717 | 5/1986 | Pottier et al. | 439/190 |

FOREIGN PATENT DOCUMENTS

| | | | |
|---|---|---|---|
| 2529396 | 12/1983 | France . | |
| 2576718 | 1/1986 | France . | |
| 2113484 | 8/1983 | United Kingdom | 439/190 |
| 2138223 | 10/1984 | United Kingdom . | |

*Primary Examiner*—Gary F. Paumen

*Attorney, Agent, or Firm*—Sughrue, Mion, Zinn, Macpeak and Seas

[57] ABSTRACT

An underwater electric connector includes two elements (1,9) which may be coupled end to end and which are each equipped with a cylindrical cavity and a set of contact pieces (17, 20). One of the elements (1) is equipped with a device for injecting an insulating fluid under pressure. Housings (2,8) of the elements have end pieces (11,10) which may be fitted one onto the other. Each set of contact pieces is secured on the element (1,9) which carries it. A cylindrical pin (22) bears two groups (24,25) of contact pieces connected electrically by twos from one group (24) to the other (25), and is equipped with a head (26,23) which seals the cylindrical cavity (19) of the second element (9) when the pin is completely inserted. Devices for gripping (27) and displacement (28) are provided in the first element to secure the pin in the position at which its contacts (24,25) are opposite the contact pieces of the two sets (17,20) of contacts.

3 Claims, 4 Drawing Sheets

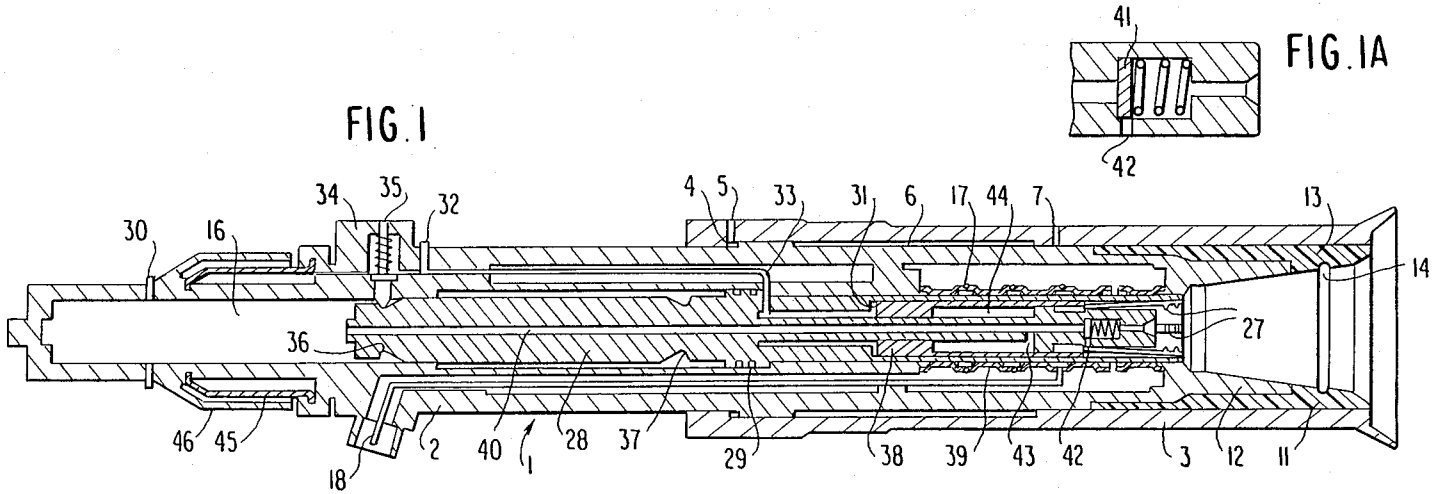
FIG. 1
FIG. 1A
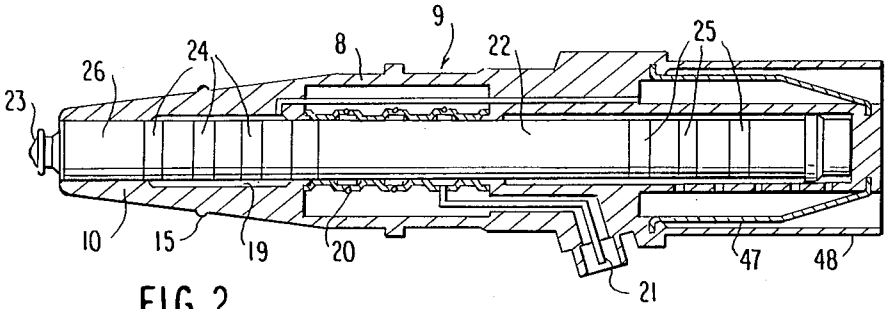
FIG. 2

UNDERWATER ELECTRIC CONNECTOR

BACKGROUND OF THE INVENTION

The present invention concerns electric connectors which enable electrical connections to be made and broken under water. The invention applies, more particularly, to electric connections transmitting high voltages, for example in the megawatt range. An electric connection of this type is found most notably in plans for underwater hydrocarbon transfer facilities which connect a motor-driven pump to an electrical energy mains transformer.

In published British Patent Application No. 2 138 223, a connector is proposed in which two carrier elements, one having male contact pieces and the other, female contact pieces, are connected one to the other by means of a watertight, threaded device; an electric control allows the male contact pieces to be moved on their carrier element in such a way that they are brought into contact with the female contact pieces of the other element. Electric connection and disconnection are thus made possible in a watertight compartment sheltered from the environment. However, the two elements carrying the contact pieces may not be separated one from the other under water, without risk of water entering the connector after its reassembly.

U.S. Pat. No. 3,461,479 describes a connector comprised of a female element equipped with a central cavity generally cylindrical in shape. This cavity is bordered laterally by contact pieces and by a male element comprised of a pin carrying lateral contact pieces; this element is designed to fit in a watertight manner into the cavity and to expel water that has previously entered the assembly. It is practically impossible to avoid water in the connector after reassembly.

Attempts have been made to remedy these difficulties by providing, in the cavity of the female element of such a connector, a sealing piston set in a resting position which fills the cavity opening and blocks that opening; this piston may be drawn back into the cavity as a result of the thrust of the pin, thus enabling the pin to enter the cavity. This arrangement is described in U.S. Pat. Nos. 3,729,699 and 3,845,450, as well as in French Patent No. 2,529,396. In addition, this system is perfected in U.S. Pat. No. 4,188,084, which provides for directing a stream of oil under pressure between the ends of the pin and the sealing piston plunger at the instant when these ends are about to come into contact with each other, in order to avoid the entry of foreign bodies into the female element.

These devices exhibit, however, serious disadvantages. The pin, while maintaining watertightness, must slide along its entire path upon existing the male element and entering the female element; this arrangement is difficult to achieve and to keep serviceable. The sealing piston and the flexible device which draws it into a resting position must function without failure over the serviceable life of the female element. Since this element normally remains stationary, a very long life is usually expected.

SUMMARY OF THE INVENTION

During the research that led to the present invention, a connector reliability of at least two years for the mobile element and of ten years for the stationary element was chosen. This result has been achieved, by providing, first, for a watertight connection between the ends of the housings of the two elements comprising the connector, a connection that may be achieved at the same time that water present at these ends is expelled; and second, for a contact-carrying pin equipped with two separate groups of contact pieces that are electrically connected by twos from one group to the other. The pin, which is inserted in its entirety in the stationary element, ensures the watertight sealing of the element; pulled by a device installed in the mobile element, it enters this element in order to establish electric connection between the two connector elements.

One object of the invention is thus to provide an electric connector incorporating two elements having elongated housings which may be connected end to end one to the other by means of a coupling endpiece, each one of which has a longitudinal cylindrical cavity and a series of contact pieces within this cavity. A first of these two elements is equipped with a device for injecting a nonconducting fluid under pressure mounted at the coupling end-piece of the element. The invention is also characterized by the fact that the housing of the second element has, at the coupling end-piece of the element, a conically-shaped pointed end-piece, and the housing of the first element has, at the coupling end-piece of the element, a conically-shaped wide-mouthed end-piece designed to fit onto the pointed end, with a clamping mechanism ensuring that the two ends are held in an interlocking position. It is also characterized by the fact that each series of contact pieces on the elements is secured onto the element which carries it and arranged around the element's cylindrical cavity, while a pin, which slides in the cavities and carries laterally two groups of contact pieces electrically connected by twos from one group to the other and arranged in such a way that the two groups may simultaneously fit into the two series of contacts pieces, respectively, of the elements coupled together, is equipped with a head for closing and gripping which seals the cylindrical cavity of the second element when the pin, set in the resting position, is completely inserted in this second element, with the first element being equipped with a device for gripping and sliding for the purpose of gripping the head and drawing the pin into operating position in which, when partially inserted into each of the two elements coupled together, the pin positions the contacts of the two groups of contact pieces opposite the contact pieces of the two series of contacts of the two connected elements.

It is, therefore, possible to obtain, under water, a watertight connection between the two connector element assemblies, by first expelling all water which may have collected between the two elements, and then by effecting, sheltered by these two housings, the partial transfer of the connection pin from the second to the first element, in order to produce the desired electrical connection. The second element, which is the stationary element and must have a very long life, has no functioning mechanical component. The connection pin moves, in fact, by means of the gripping and displacement devices located in the first mobile element, which may have a shorter lifespan.

BRIEF DESCRIPTION OF THE DRAWINGS

Other features of the electrical connector specified in the present invention will emerge from the description of an embodiment that will be given, as a non-limitative example, with reference to the attached drawings, in which:

FIG. 1 is a longitudinal cross-section showing the first, mobile element of an electric connector;

FIG. 1A is an enlargement of a portion of FIG. 1.

FIG. 2 is a similar representation of the second, stationary element of the connector;

DETAILED DESCRIPTION OF THE PREFERRED EMBODIMENT

Figure 3:
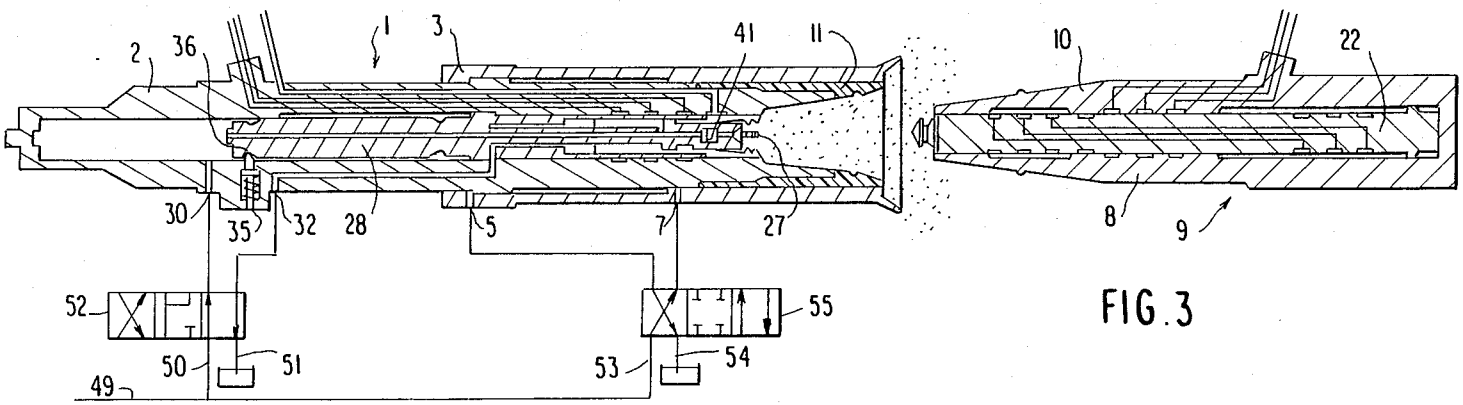
FIGS. 3 to 8 show the entirety of the two elements comprising the electrical connector in the following successive positions, respectively: initial preparatory position; coupling and clamping; gripping of the connection pin; electrical connection; electrical disconnection; uncoupling.

The mobile element 1 shown in FIG. 1, which may, for example, be connected to a motor-driven pump, is contained in a cylindrical housing 2, which may, for example, be made of bronze and which slides in a cylindrical support 3 and may be moved toward the right of FIG. 1 if a liquid under pressure is introduced into a chamber 4 through an opening 5, or toward the left of FIG. 1 if a liquid under pressure is introduced into chamber 6 through an opening 7. The hydraulic jack comprised of chambers 4 and 6, placed between the housing 2 and the support 3, allows the housing 2 of the mobile element 1 to be moved forward or retracted in relation to the housing 8 of the stationary element 9; it may, for example, be connected to an electrical transformer shown in FIG. 2. Different successive, relative positions of elements 1 and 9 are shown in FIGS. 3 to 8.

Elements 1 and 9 may be connected one to the other by means of their coupling end-pieces, located to the right of FIG. 1 and to the left of FIG. 2, respectively. For this purpose, the housing 8 of the element 9, the male body, is equipped with a conical pointed end-piece 10, and the housing 2 of element 1, the female body, with a conical wide-mouthed end-piece 11, whose internal dimensions are designed to correspond to the external dimensions of the pointed end-piece 10, in such a way that end-piece 11 may fit over the end-piece 10, forming a watertight seal. The wide-mouthed end-piece 11 is comprised of a relatively rigid portion 12 and of a relatively flexible portion 13, made, for example, of polyurethane, which is an extension of portion 12 and inside of which is located a locking groove 14 operating in conjunction with a locking flange 15 formed on the pointed end-piece 10, in order to ensure that the two elements 1 and 9 will be kept in a coupled position.

Inside the element 1 is found a central and longitudinal cylindrical cavity 16, around which a series of contact pieces 17 electrically connected to an electric cable 18 is arranged. These contacts 17 have the shape of contact rings supported on a cylindrical non-conducting body which marks the extremity of the cavity 16 along a portion of the cavity length. A central and longitudinal cylindrical cavity 19 is located inside element 9; around this cavity a series of contacts pieces 20, electrically connected to an electric cable 21, is arranged. These contact pieces 20 have the shape of contact rings supported by a cylindrical insulating piece which marks the end of the cavity 19 along a portion of the cavity length.

A cylindrical connection pin 22, shown completely inserted in the cavity 19 of element 9 on FIG. 2, except for the gripping head 23 protruding from the element 9, supports two groups, 24 and 25 respectively, of annular contact pieces, which are designed to fit simultaneously into the contact pieces making up the set of contact pieces 17 on element 1 and the contact pieces making up the set of contact pieces 20 on element 9, respectively, after coupling of elements 1 and 9. The contact pieces in group 24 make up, with the contact pieces in group 25, pairs of contact pieces that are electrically connected, and the role of these contact pieces consists of connecting electrically the set of contact pieces 17 on element 1 to the set of contact pieces 20 on element 9. In the pin resting position as shown in FIG. 2, the group of contact pieces 24 and the group of contact pieces 25 on the pin 22 are located longitudinally on either side of the set of contact pieces 20 on element 9; when, on the other hand, the pin 22 is in working position, the group of contact pieces 24 located on the pin fits onto the set of contact pieces 17 on element 1, and the group of contact pieces 25 on the pin 22 fits onto the set of contact pieces 20 on element 9, as a result of the translational movement of the pin 22, which at that moment extends into the cavity 16 of element 1. The pin 22 is equipped, at its left-hand end as shown in FIG. 2, with a watertight sealing device 26 which hermetically seals up element 9 when the pin 22 is in the resting position.

The mobile element 1 contains an oil-injection mechanism inside the conical wide-mouthed end 11, and a device for gripping and moving the gripping head 23 of the connection pin 22. These devices have been combined in order to reduce the number of oil feeding tubes and to facilitate operational control, as well as to reduce the bulkiness of element 1.

The mechanism for gripping the head 23 includes a clamp 27 mounted on the forward end (to the right in FIG. 1) of a displacing piston 28, which slides within the cylindrical cavity 16 and which is equipped with annular sealing gaskets 29. This piston 28 makes up, with the housing 2 within the cylindrical cavity 16, a displacement jack, whose rear chamber may be fed through an intake 30 and whose front chamber 31 may be fed through an intake 32 and a tube 33. In FIG. 1, the intake 30 is shown substantially displaced from the intake 32 in order to clarify the drawing; however, these two intakes may be placed in a single block 34, which also contains bolts 35 working in conjunction with annular notches 36 and 37 cut into the piston 28 in order to hold the piston in the rearward and forward positions, respectively (securing of the piston in the forward position may also be obtained by a simple stop). A pin 22 position indicator may be installed in the cavity 16, and the bolts 35 may be equipped with studs for controlling their position.

The clamp 27 is open in the resting position. It may be closed by moving forward a sealing piston 38 which is extended forward by means of a cylindrical tube 39 which, in the forward position, presses against the clamp 27.

The piston 28 has an axial, internal passage 40 for the introduction of oil, for example silicon oil, into the front part of the piston 28 from the rear chamber of the piston displacement jack. A calibrated valve 41, installed at the front part of the passage 40, allows the injection of oil under pressure through the openings 42 at the front of element 1. A transverse passage 43 between the axial passage 40 and an annular chamber 44 located in the front part of the chamber 31 and separated from this chamber by the clamp sealing piston 38, allows this piston to be kept in a forward position when the intake 30 is fed, while feeding of the intake 32 ensures closing of the clamp 27 even if the intake 30 is also supplied, since the action of the chamber 31 on the piston 38 is preponderant in relation to the action of the chamber 44. The chamber 31, when fed through the intake 32 and when the intake 30 is no longer supplied with oil under pressure, effects the rearward displacement of the piston 28, because the effective surface area on the piston at a right angle to the annular sealing gaskets 29 is greater than the effective surface area on this piston at a right angle to the piston 38.

Element 1 is equipped with an equivalent-pressure membrane 45 surrounded by a protective hood 46, and the element 9 is equipped with a equivalent-pressure membrane 47 covered by a protective hood 48.

In FIGS. 3 to 8, the darkened parts represent the elements filled with oil. A pressurized oil feeding system 49 has been provided, which divides into a tube 50 which, with a discharge duct 51, is connected to the intakes 30 and 32 by means of a distributor valve 52, and a tube 53, which, with a discharge duct 54, is connected to the openings 5 and 7 by means of a distributor valve 55.

FIG. 3 shows the phase preparatory to the coupling of the elements 1 and 9. The housing 2 of the element 1 is at this stage still kept in a rearward position in relation to the support 3, by means of the pressurized oil feeding of the opening 7. The intake 30 is fed with oil under pressure, which causes the opening of the calibrated valve 41 and an injection of oil under pressure into the internal space in the wide-mouthed end-piece 11, and which holds the clamp in the open position. In addition, the piston 28 is in the forward position.

Figure 4:
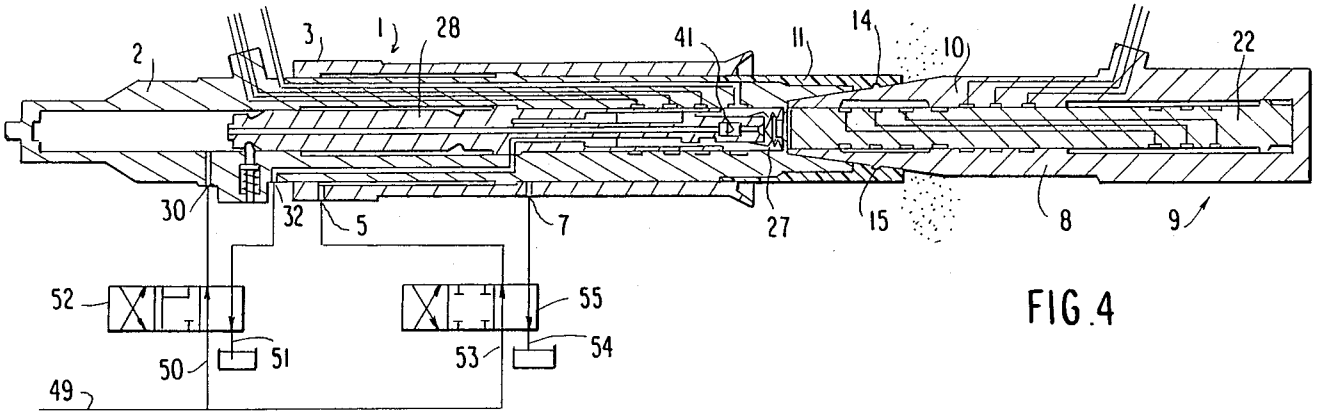

The approach, centering and alignment of the housing 2 in relation to the housing 8 of the element 9 are then carried out by feeding the opening 5 with pressurized oil as shown in FIG. 4, thus causing the forward movement of the housing 2 toward the housing 8, at the same time that the intake 30 continues to be fed with pressurized oil in order to hold the clamp 27 and the calibrated valve 41 in the open position. The wide-mouthed end-piece 11 fits over the pointed end-piece 10, while water collected between the elements 1 and 9 is expelled by the oil injected into the wide-mouthed end-piece 11. The flange 15 fits into the groove 14, thus locking the elements 1 and 9 in the coupling position.

Figure 5:
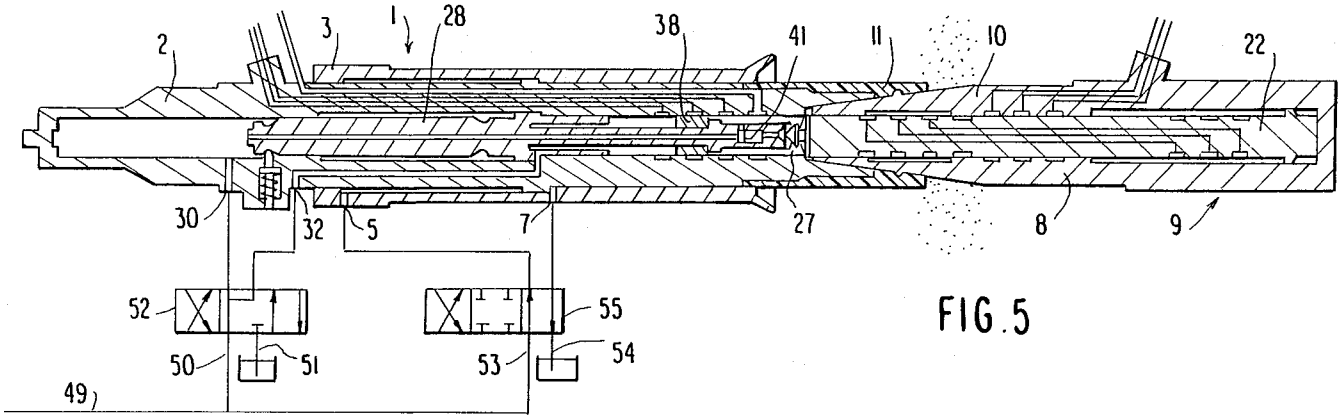

Oil pressure on opening 5 and intake 30 is maintained, and, in addition, pressurized oil is fed to intake 32, as shown in FIG. 5, in order to close the clamp by means of forward displacement of the sealing piston 38.

Figure 6:
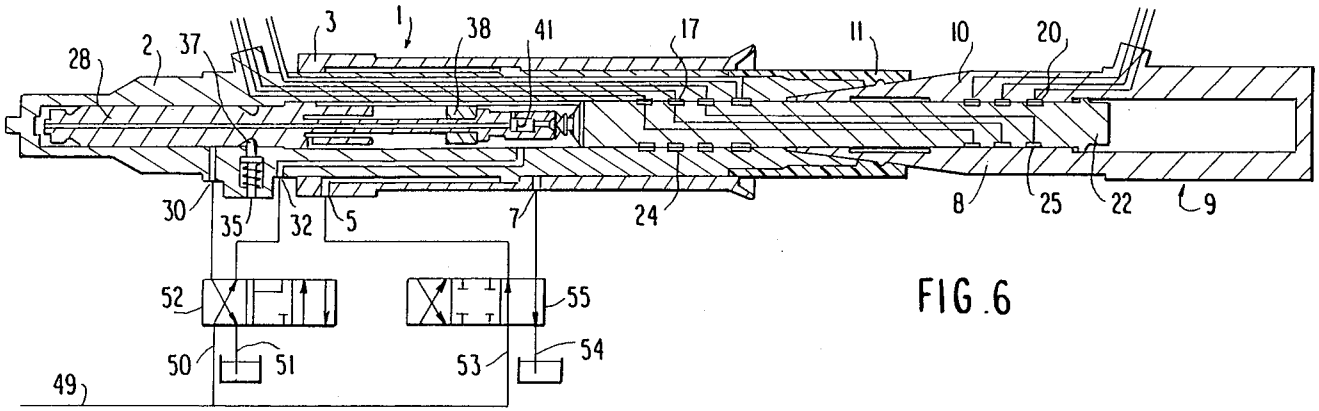

The electrical connection of elements 1 and 9 may now be effected. For this purpose, the feeding of intake 30 is halted as shown in FIG. 6. Because of the differential in surface areas bordering the chamber 31, feeding of the intake 32 causes displacement to the left in FIG. 6 of the piston 28, and, as a consequence, of the connection pin 22, whose contact pieces 24 and 25 fit onto the contact pieces 17 of element 1 and the contact pieces 20 of element 9, respectively, while the clamp 27 remains closed. The piston 28 is held in this rearward position by the engaging of the bolts in the notch 37.

Figure 7:
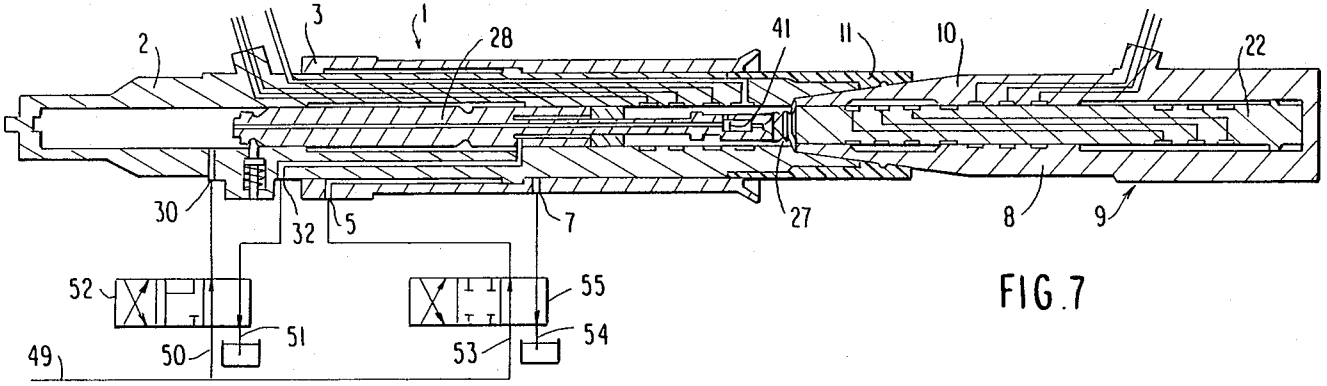

If the disconnection of elements 1 and 9 is desired, the intake 30 is fed, as shown in FIG. 7, while, at the same time, pressure is maintained on opening 5. The pin 22 is withdrawn into element 9 and the clamp 27 opens as a result of the lack of feeding of intake 32.

Figure 8:
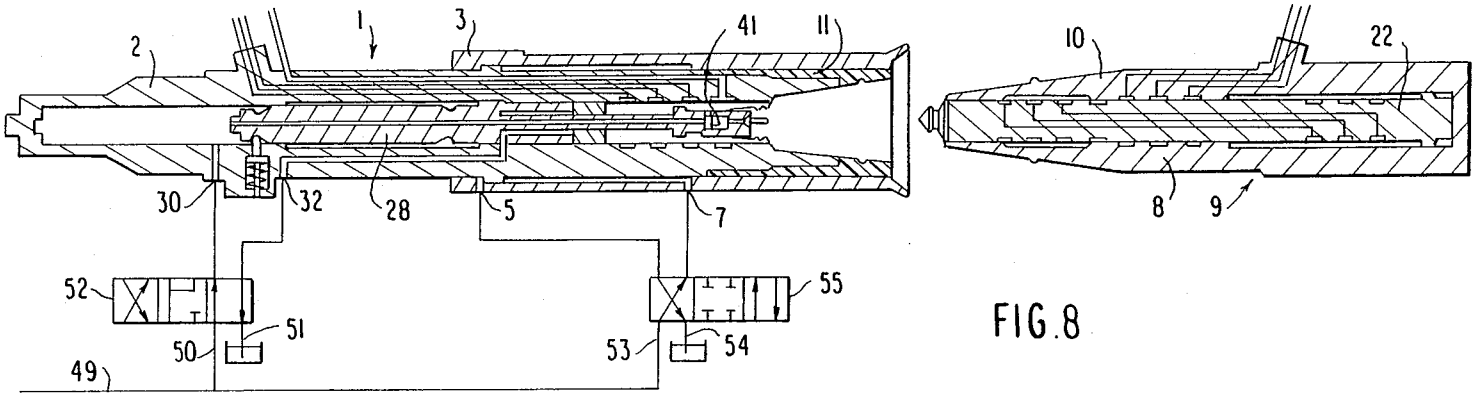

Uncoupling of elements 1 and 9 may then be achieved by feeding pressurized oil into opening 7 instead of opening 5, as shown in FIG. 8.

If, despite the high degree of reliability of the connector components, connection resulting from the normal procedure cannot be achieved, a safety disconnection is carried out. In the event that the bolts 35 do not open, the pressure exerted on intake 30 would be increased (for example, from the 105 bars in normal use to 210 bars) in order to shear off locking slugs from the bolts; the normal procedure would then be followed. In the event that the clamp 27 should not open, the pressure exerted on the intake 32 and the opening 7 would be increased, in order to cause the breaking of the clamp fingers; the normal disconnection procedure would then be followed from the beginning. When the uncoupling of the housings 2 and 8 is not achieved, an injection of oil through intake 30 would be undertaken, in order to disengage the wide-mouthed end-piece 11 from the pointed end-piece 10, after which the discharge of pressurized oil in the opening 7 would permit the separation of housings 2 and 8.

Tests carried out at a voltage of 2,000 V with peaks of 4,000 V on a connector built according to the invention model have shown that the contact pieces can handle a current of 450 A, and that, after 50 operations involving coupling, connection, disconnection, and uncoupling, the insulating resistance remained equal to at least 1,000M.

Many variants may obviously be made in the manufacture of the connector, especially in the coupling and connection components and in the displacement jacks and their control circuits.

During another series of trials, the connector was subjected to a total of 25 operations under pressure in a water-filled tank, without any findings of deterioration or reduction in resistance. The connector was kept for seven months at a depth of 150 meters, and transmitted power of up to 1,100 kw to an underwater motor-driven pump.

We claim:

1. Electric connector comprising two elements (1, 9) having elongated housings capable of being coupled end to end one to the other by means of a coupling end-piece on each said element, and each said element being equipped with a longitudinal cylindrical cavity and a set of contact pieces within said cavity, a first (1) of said elements being equipped with a device injecting an insulating fluid under pressure into said first element, said device being mounted at the coupling end of said first element, characterized by the fact that the housing (8) of the second element (9) has, at the coupling end of said second element, a conically-shaped pointed end-piece (10) and that the housing (2) of the first element (1) has, at the coupling end of said first element, a conically-shaped wide-mouthed end-piece (11) designed to fit over said pointed end-piece (10), a clamping device (14, 15) between said two end-pieces (10, 11) ensuring maintenance of said end-pieces in a mated position, each said set of contact pieces (17, 20) of said elements being stationary on the element (1, 9) to which it is secured, and being arranged around the cylindrical cavity (16, 19) of said element, and a cylindrical connection pin (22) capable of sliding within said cavities (16, 19) and having two groups (24, 25) of contact pieces which are electrically interconnected and arranged so that the two groups (24, 25) may simultaneously electrically interconnect the two sets (17, 20) of contact pieces of the coupled said elements (1, 9), said pin being equipped with a sealing and gripping head (26, 23) which seals the cylindrical cavity (19) of the second element (9) when said pin (22), in a resting position, is totally inserted in said second element (9), gripping (27) and displacement (28) devices being provided in the first element in order to grip said head (23) and draw said pin (22) into a working position in which, partially inserted in each of the two coupled elements (1, 9), said pin positions contact pieces from its two groups of contact pieces (24, 25) opposite the contact pieces of the two sets of contact pieces (17, 20) of the two coupled elements (1, 9).

2. Connector according to claim 1, wherein said gripping and displacement devices include a displacement piston (28) working in conjunction with a housing (2) of the first element (1) in said cylindrical cavity (16) of said first element (1) in order to constitute a displacement jack equipped with an axial passage (40) to draw a pressurized insulating fluid to the coupling end of said first element (1), said displacement piston carrying a clamp (27), a sealing piston (38, 39) sliding over the displacement piston (28) in order to close said clamp (27).

3. Connector according to claim 2, wherein said displacement piston (28) constitutes, with said housing (2) of the first element (1) in said cavity (16) of the first element, a chamber for advancing said displacement piston forward toward the second element (9) and a chamber (31) for withdrawal of said displacement piston, said connector being characterized by the fact that said sealing piston (38, 39) is bordered by said chamber (31) for withdrawal of the displacement piston, the chamber acting also to draw said sealing piston into position for closing of the clamp (27), and said sealing piston is also bordered by an annular chamber (44) formed between the displacement piston (28) and the sealing piston (38, 39), said annular chamber adapted to bring said sealing piston (38, 39) back into the position opening the clamp (27) and being connected to an axial passage (40), the action exerted on the sealing piston (38, 39) by said annular chamber (44) being less than the action exerted by said chamber (31) on the withdrawal of the displacement piston.

* * * * *